US009664158B2

(12) United States Patent
Nehl et al.

(10) Patent No.: US 9,664,158 B2
(45) **Date of Patent: *May 30, 2017**

(54) ACTUATOR WITH INTEGRATED DRIVER

(71) Applicant: GM GLOBAL TECHNOLOGY OPERATIONS LLC, Detroit, MI (US)

(72) Inventors: Thomas Wolfgang Nehl, Shelby Township, MI (US); Chandra S. Namuduri, Troy, MI (US); Suresh Gopalakrishnan, Troy, MI (US); Avoki M. Omekanda, Rochester, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 88 days.

This patent is subject to a terminal disclaimer.

(21) Appl. No.: 14/657,382

(22) Filed: Mar. 13, 2015

(65) Prior Publication Data

US 2015/0267662 A1 Sep. 24, 2015

Related U.S. Application Data

(60) Provisional application No. 61/955,953, filed on Mar. 20, 2014.

(51) Int. Cl.
*F02M 51/00* (2006.01)
*F02D 41/20* (2006.01)
(Continued)

(52) U.S. Cl.
CPC ..... *F02M 51/005* (2013.01); *F02D 41/20* (2013.01); *F02D 41/28* (2013.01); *F02M 51/061* (2013.01);
(Continued)

(58) Field of Classification Search
CPC ..... F02D 41/20; F02D 41/28; F02D 41/266; F02D 41/402; F02D 2041/2058;
(Continued)

(56) References Cited

U.S. PATENT DOCUMENTS 5,381,297 A 1/1995 Weber
5,831,809 A 11/1998 Schmitz
(Continued)

FOREIGN PATENT DOCUMENTS

DE 34 37 053 C2 6/1985
DE 196 43 788 A1 5/1998
(Continued)

OTHER PUBLICATIONS

A. M. Pawlak, Transient Finite Element Modeling of Solenoid Actuators, IEEE Transactions on Magnetics, Jan. 1988, 270-273, vol. 24, No, 1.
(Continued)

*Primary Examiner* — John Kwon
*Assistant Examiner* — Johnny H Hoang

(57) ABSTRACT

An apparatus for controlling operation of an electromagnetically-activated actuator includes an activation controller that is one of integrated within a connector assembly of the actuator and integrated into a power transmission cable in close proximity to the actuator. The activation controller comprises a control module configured to generate an actuator command signal, and an actuator driver comprising a bi-directional current driver. The actuator driver is configured to receive the actuator command signal from the control module and generate an activation command signal for controlling the direction and amplitude of the current provided to the actuator.

20 Claims, 5 Drawing Sheets

(51) Int. Cl.

| | |
|---|---|
| ***F02M 51/06*** | (2006.01) |
| ***H01F 7/06*** | (2006.01) |
| ***F02D 41/28*** | (2006.01) |
| *F02D 41/26* | (2006.01) |

(52) U.S. Cl.
CPC ..... *F02M 51/0625* (2013.01); *H01F 7/064* (2013.01); *F02D 41/266* (2013.01); *F02D 2041/2072* (2013.01)

(58) Field of Classification Search
CPC ..... F02D 2041/2072; F02M 51/005; F02M 51/0671; F02M 51/0689; F02M 57/005; F02M 63/0017; F02M 2200/08; F02M 2200/20; F02M 2200/24; Y02T 10/44; H01F 7/0064
USPC ..... 123/294, 445, 472, 478, 490, 498, 499; 701/102, 105, 106
See application file for complete search history.

(56) References Cited

U.S. PATENT DOCUMENTS

| | | | | |
|---|---|---|---|---|
| 6,168,135 | B1 | 1/2001 | Fochtman | |
| 6,321,700 | B1 | 11/2001 | Hein | |
| 2002/0148442 | A1* | 10/2002 | Fraenkle | F02M 47/027 123/446 |
| 2003/0184946 | A1 | 10/2003 | Kolmanovsky | |
| 2007/0056784 | A1* | 3/2007 | Joe | B60K 6/48 180/65.245 |
| 2007/0120332 | A1* | 5/2007 | Bushko | B60G 3/01 280/5.508 |
| 2007/0285195 | A1 | 12/2007 | Nehl | |
| 2008/0204178 | A1 | 8/2008 | Maranville | |
| 2010/0018503 | A1 | 1/2010 | Perry | |
| 2011/0125391 | A1 | 5/2011 | McAlister | |
| 2012/0018262 | A1 | 1/2012 | Winkler | |
| 2012/0101707 | A1 | 4/2012 | Kemmer | |
| 2012/0239278 | A1 | 9/2012 | Becker | |
| 2012/0247428 | A1 | 10/2012 | Grimminger | |
| 2013/0113407 | A1 | 5/2013 | Neelakantan | |
| 2013/0133748 | A1 | 5/2013 | Lehner | |
| 2014/0069533 | A1 | 3/2014 | Gorzen | |
| 2014/0092516 | A1 | 4/2014 | Koch | |
| 2014/0110508 | A1 | 4/2014 | Dames | |
| 2015/0123622 | A1 | 5/2015 | Yasui | |
| 2015/0267660 | A1 | 9/2015 | Nehl | |
| 2015/0267661 | A1* | 9/2015 | Namuduri | F02M 51/0689 239/585.1 |
| 2015/0267662 | A1* | 9/2015 | Nehl | F02M 51/005 123/294 |
| 2015/0267663 | A1 | 9/2015 | Namuduri | |
| 2015/0267666 | A1 | 9/2015 | Gopalakrishnan | |
| 2015/0267667 | A1 | 9/2015 | Namuduri | |
| 2015/0267668 | A1* | 9/2015 | Gopalakrishnan | F02D 41/1401 239/585.1 |
| 2015/0267669 | A1 | 9/2015 | Nehl | |
| 2015/0267670 | A1 | 9/2015 | Nehl | |
| 2015/0285175 | A1 | 10/2015 | Parrish | |

FOREIGN PATENT DOCUMENTS

| | | | |
|---|---|---|---|
| DE | 199 21 938 | A1 | 12/1999 |
| DE | 10 2007 053 877 | B3 | 4/2009 |
| DE | 10 2011 083 007 | A1 | 3/2013 |
| DE | 10 2012 208 781 | B4 | 11/2013 |
| EP | 0 074 420 | A1 | 3/1983 |
| EP | 1670005 | A2 | 6/2006 |
| EP | 2336544 | A1 | 6/2011 |
| JP | 10-311265 | A | 11/1998 |
| JP | 2007-270658 | A | 10/2007 |
| KR | 10-2002-0094494 | A | 12/2002 |
| WO | WO 90-02872 | A1 | 3/1990 |
| WO | WO 87-01765 | A1 | 3/1997 |
| WO | WO 2015 143107 | A1 | 9/2015 |
| WO | WO 2015 143109 | A1 | 9/2015 |
| WO | WO 2015 143116 | A1 | 9/2015 |

OTHER PUBLICATIONS

T. W. Nehl, ANTIC85: A General Purpose Finite Element Package for Computer Aided Design, IEEE Transactions on Magnetics, Jan. 1988, 358-361, vol. 24, No. 1.

* cited by examiner

ACTUATOR WITH INTEGRATED DRIVER

CROSS REFERENCE TO RELATED APPLICATIONS

This application claims the benefit of U.S. Provisional Application No. 61/955,953, filed on Mar. 20, 2014.

TECHNICAL FIELD

This disclosure is related to solenoid-activated actuators.

BACKGROUND

The statements in this section merely provide background information related to the present disclosure. Accordingly, such statements are not intended to constitute an admission of prior art.

Solenoid actuators can be used to control fluids (liquids and gases), or for positioning or for control functions. A typical example of a solenoid actuator is the fuel injector. Fuel injectors are used to inject pressurized fuel into a manifold, an intake port, or directly into a combustion chamber of internal combustion engines. Known fuel injectors include electromagnetically-activated solenoid devices that overcome mechanical springs to open a valve located at a tip of the injector to permit fuel flow therethrough. Injector driver circuits control flow of electric current to the electromagnetically-activated solenoid devices to open and close the injectors. Injector driver circuits may operate in a peak-and-hold control configuration or a saturated switch configuration.

Fuel injectors are calibrated, with a calibration including an injector activation signal including an injector open-time, or injection duration, and a corresponding metered or delivered injected fuel mass operating at a predetermined or known fuel pressure. Injector operation may be characterized in terms of injected fuel mass per fuel injection event in relation to injection duration. Injector characterization includes metered fuel flow over a range between high flow rate associated with high-speed, high-load engine operation and low flow rate associated with engine idle conditions.

It is known to connect an external injector driver to a fuel injector via wires and/or cables. These wires have resistive drops and parasitic capacitances and inductances that interfere with current travelling from the injector driver to the fuel injector, thereby affecting high speed operation of the fuel injector. Additionally, accuracy of voltage and flux measurements within the fuel injector that may be provided as feedback to the external injector driver. The accuracy of these voltage and flux measurements may be impacted due to the distance these measurements must travel through the wires connecting fuel injector to the injector driver.

SUMMARY

An apparatus for controlling operation of an electromagnetically-activated actuator includes an activation controller that is one of integrated within a connector assembly of the actuator and integrated into a power transmission cable in close proximity to the actuator. The activation controller comprises a control module configured to generate an actuator command signal, and an actuator driver comprising a bi-directional current driver. The actuator driver is configured to receive the actuator command signal from the control module and generate an activation command signal for controlling the direction and amplitude of the current provided to the actuator.

BRIEF DESCRIPTION OF THE DRAWINGS

One or more embodiments will now be described, by way of example, with reference to the accompanying drawings, in which:

FIGS. 3-1 thru 3-3 illustrate an exemplary embodiment of an injector driver for controlling operation of a fuel injector integrated within a connector assembly of the fuel injector, in accordance with the present disclosure.

DETAILED DESCRIPTION

This disclosure describes the concepts of the presently claimed subject matter with respect to an exemplary application to linear motion fuel injectors. However, the claimed subject matter is more broadly applicable to any linear or non-linear electromagnetic actuator that employs an electrical coil for inducing a magnetic field within a magnetic core resulting in an attractive force acting upon a movable armature. Typical examples include fluid control solenoids, gasoline or diesel or CNG fuel injectors employed on internal combustion engines and non-fluid solenoid actuators for positioning and control.

Figure 1:
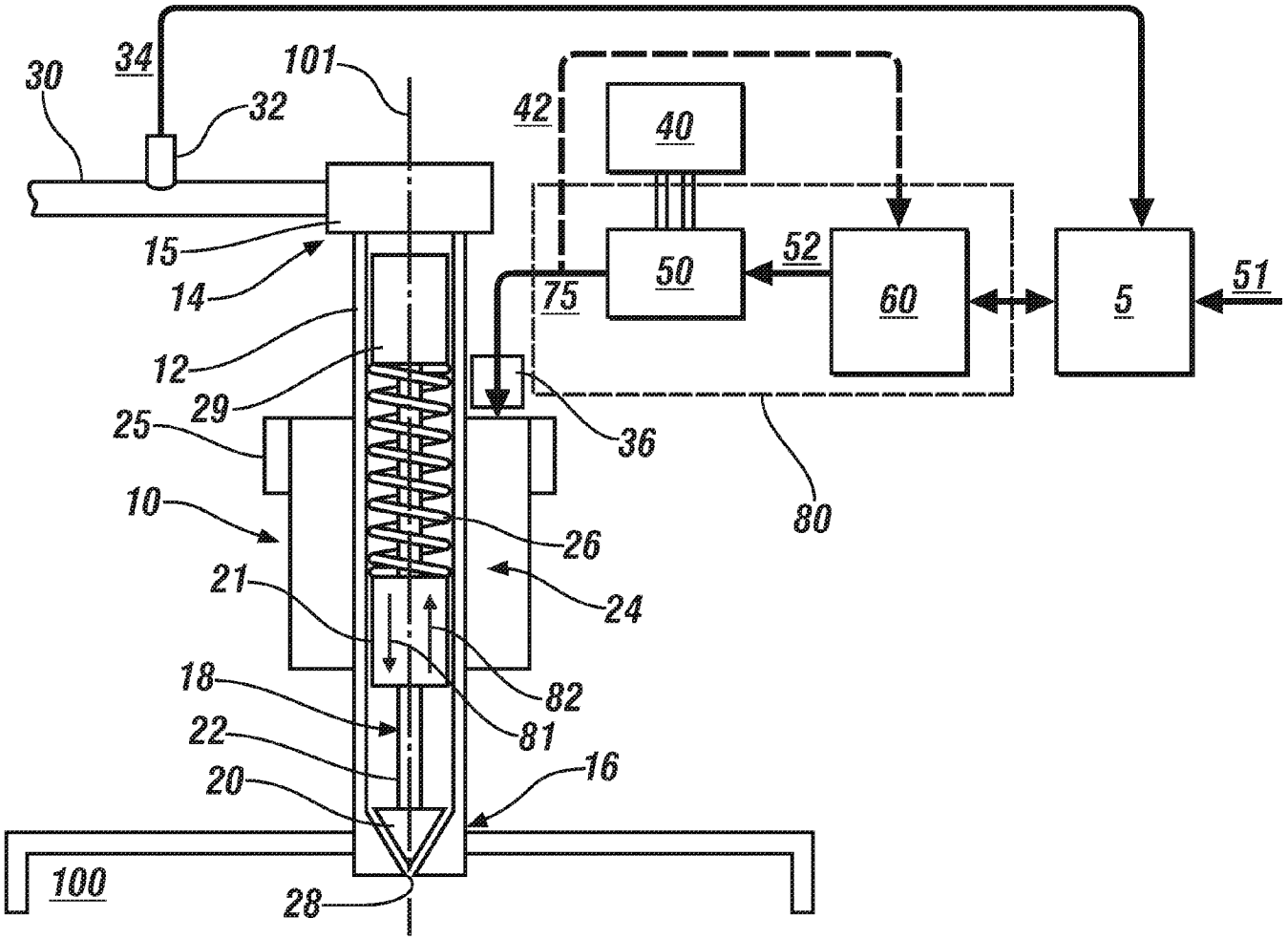
FIG. 1 illustrates a schematic sectional view of a fuel injector and an activation controller, in accordance with the present disclosure.

Referring now to the drawings, wherein the showings are for the purpose of illustrating certain exemplary embodiments only and not for the purpose of limiting the same, FIG. 1 schematically illustrates a non-limiting exemplary embodiment of an electromagnetically-activated direct-injection fuel injector 10. While an electromagnetically-activated direct-injection fuel injector is depicted in the illustrated embodiment, a port-injection fuel injector is equally applicable. The fuel injector 10 is configured to inject fuel directly into a combustion chamber 100 of an internal combustion engine. An activation controller 80 electrically operatively connects to the fuel injector 10 to control activation thereof. The activation controller 80 corresponds to only the fuel injector 10. In the illustrated embodiment, the activation controller 80 includes a control module 60 and an injector driver 50. The control module 60 electrically operatively connects to the injector driver 50 that electrically operatively connects to the fuel injector 10 to control activation thereof. The fuel injector 10, control module 60 and injector driver 50 may be any suitable devices that are configured to operate as described herein. In the illustrated embodiment, the control module 60 includes a processing device. In one embodiment, one or more components of the activation controller 80 are integrated within a connection assembly 36 of the fuel injector 36. In another embodiment, one or more components of the activation controller 80 are integrated within a body 12 of the fuel injector 10. In even yet another embodiment, one or more components of the activation controller 80 are external to—and in close proximity with—the fuel injector 10 and electrically operatively connected to the connection assembly 36 via one or more cables and/or wires. The terms "cable" and "wire" will be used interchangeably herein to provide transmission of electrical power and/or transmission of electrical signals.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

In general, an armature is controllable to one of an actuated position and a static or rest position. The fuel injector 10 may be any suitable discrete fuel injection device that is controllable to one of an open (actuated) position and a closed (static or rest) position. In one embodiment, the fuel injector 10 includes a cylindrically-shaped hollow body 12 defining a longitudinal axis 101. A fuel inlet 15 is located at a first end 14 of the body 12 and a fuel nozzle 28 is located at a second end 16 of the body 12. The fuel inlet 15 is fluidly coupled to a high-pressure fuel line 30 that fluidly couples to a high-pressure injection pump. A valve assembly 18 is contained in the body 12, and includes a needle valve 20, a spring-activated pintle 22 and an armature portion 21. The needle valve 20 interferingly seats in the fuel nozzle 28 to control fuel flow therethrough. While the illustrated embodiment depicts a triangularly-shaped needle valve 20, other embodiments may utilize a ball. In one embodiment, the armature portion 21 is fixedly coupled to the pintle 22 and configured to linear translate as a unit with the pintle 22 and the needle valve 20 in first and second directions 81, 82, respectively. In another embodiment, the armature portion 21 may be slidably coupled to the pintle 22. For instance, the armature portion 21 may slide in the first direction 81 until being stopped by a pintle stop fixedly attached to the pintle 22. Likewise, the armature portion 21 may slide in the second direction 82 independent of the pintle 22 until contacting a pintle stop fixedly attached to the pintle 22. Upon contact with the pintle stop fixedly attached to the pintle 22, the force of the armature portion 21 causes the pintle 22 to be urged in the second direction 82 with the armature portion 21. The armature portion 21 may include protuberances to engage with various stops within the fuel injector 10.

An annular electromagnet assembly 24, including an electrical coil and magnetic core, is configured to magnetically engage the armature portion 21 of the valve assembly. The electrical coil and magnetic core assembly 24 is depicted for illustration purposes to be outside of the body of the fuel injector; however, embodiments herein are directed toward the electrical coil and magnetic core assembly 24 to be either integral to, or integrated within, the fuel injector 10. The electrical coil is wound onto the magnetic core, and includes terminals for receiving electrical current from the injector driver 50. Hereinafter, the "electrical coil and magnetic core assembly" will simply be referred to as an "electrical coil 24". When the electrical coil 24 is deactivated and de-energized, the spring 26 urges the valve assembly 18 including the needle valve 20 toward the fuel nozzle 28 in the first direction 81 to close the needle valve 20 and prevent fuel flow therethrough. When the electrical coil 24 is activated and energized, electromagnetic force (herein after "magnetic force") acts on the armature portion 21 to overcome the spring force exerted by the spring 26 and urges the valve assembly 18 in the second direction 82, moving the needle valve 20 away from the fuel nozzle 28 and permitting flow of pressurized fuel within the valve assembly 18 to flow through the fuel nozzle 28. The fuel injector 10 may include a stopper 29 that interacts with the valve assembly 18 to stop translation of the valve assembly 18 when it is urged to open. In one embodiment, a pressure sensor 32 is configured to obtain fuel pressure 34 in the high-pressure fuel line 30 proximal to the fuel injector 10, preferably upstream of the fuel injector 10. In another embodiment, a pressure sensor may be integrated within the inlet 15 of the fuel injector in lieu of the pressure sensor 32 in the fuel rail 30 or in combination with the pressure sensor. The fuel injector 10 in the illustrated embodiment of FIG. 1 is not limited to the spatial and geometric arrangement of the features described herein, and may include additional features and/or other spatial and geometric arrangements known in the art for operating the fuel injector 10 between open and closed positions for controlling the delivery of fuel to the engine 100.

The control module 60 generates an injector command signal 52 that controls the injector driver 50, which activates the fuel injector 10 to the open position for affecting a fuel injection event. In the illustrated embodiment, the control module 60 communicates with one or more external control modules such as an engine control module (ECM) 5; however, the control module 60 may be integral to the ECM in other embodiments. The injector command signal 52 correlates to a desired mass of fuel to be delivered by the fuel injector 10 during the fuel injection event. Similarly, the injector command signal 52 may correlate to a desired fuel flow rate to be delivered by the fuel injector 10 during the fuel injection event. As used herein, the term "desired injected fuel mass" refers to the desired mass of fuel to be delivered to the engine by the fuel injector 10. As used herein, the term "desired fuel flow rate" refers to the rate at which fuel is to be delivered to the engine by the fuel injector 10 for achieving the desired mass of fuel. The desired injected fuel mass can be based upon one or more monitored input parameters 51 input to the control module 60 or ECM 5. The one or more monitored input parameters 51 may include, but are not limited to, an operator torque request, manifold absolute pressure (MAP), engine speed, engine temperature, fuel temperature, and ambient temperature obtained by known methods. The injector driver 50 generates an injector activation signal 75 in response to the injector command signal 52 to activate the fuel injector 10. The injector activation signal 75 controls current flow to the electrical coil 24 to generate electromagnetic force in response to the injector command signal 52. An electric power source 40 provides a source of DC electric power for the injector driver 50. In some embodiments, the DC electric power source provides low voltage, e.g., 12 V, and a boost converter may be utilized to output a high voltage, e.g., 24V to 200 V, that is supplied to the injector driver 50. When activated using the injector activation signal 75, the electromagnetic force generated by the electrical coil 24 urges the armature portion 21 in the second direction 82. When the armature portion 21 is urged in the second direction 82, the valve assembly 18 in consequently caused to urge or translate in the second direction 82 to an open position, allowing pressurized fuel to flow therethrough. The injector driver 50 controls the injector activation signal 75 to the electrical coil 24 by any suitable method, including, e.g., pulsewidth-modulate (PWM) electric power flow. The injector driver 50 is configured to control activation of the fuel injector 10 by generating suitable injector activation signals 75. In embodiments that employ a plurality of successive fuel injection events for a given engine cycle, an injector activation signal 75, that is fixed for each of the fuel injection events within the engine cycle, may be generated.

The injector activation signal 75 is characterized by an injection duration and a current waveform that includes an initial peak pull-in current and a secondary hold current. The initial peak pull-in current is characterized by a steady-state ramp up to achieve a peak current, which may be selected as described herein. The initial peak pull-in current generates electromagnetic force that acts on the armature portion 21 of the valve assembly 18 to overcome the spring force and urge the valve assembly 18 in the second direction 82 to the open position, initiating flow of pressurized fuel through the fuel nozzle 28. When the initial peak pull-in current is achieved, the injector driver 50 reduces the current in the electrical coil 24 to the secondary hold current. The secondary hold current is characterized by a somewhat steady-state current that is less than the initial peak pull-in current. The secondary hold current is a current level controlled by the injector driver 50 to maintain the valve assembly 18 in the open position to continue the flow of pressurized fuel through the fuel nozzle 28. The secondary hold current is preferably indicated by a minimum current level. The injector driver 50 is configured as a bi-directional current driver capable of providing a negative current flow for drawing current from the electrical coil 24. As used herein, the term "negative current flow" refers to the direction of the current flow for energizing the electrical coil to be reversed. Accordingly, the terms "negative current flow" and "reverse current flow" are used interchangeably herein.

Embodiments herein are directed toward controlling the fuel injector for a plurality of fuel injection events that are closely-spaced during an engine cycle. As used herein, the term "closely-spaced" refers to a dwell time between each consecutive fuel injection event being less than a predetermined dwell time threshold. As used herein, the term "dwell time" refers to a period of time between an end of injection for the first fuel injection event (actuator event) and a start of injection for a corresponding second fuel injection event (actuator event) of each consecutive pair of fuel injection events. The dwell time threshold can be selected to define a period of time such that dwell times less than the dwell time threshold are indicative of producing instability and/or deviations in the magnitude of injected fuel mass delivered for each of the fuel injection events. The instability and/or deviations in the magnitude of injected fuel mass may be responsive to a presence of secondary magnetic effects. The secondary magnetic effects include persistent eddy currents and magnetic hysteresis within the fuel injector and a residual flux based thereon. The persistent eddy currents and magnetic hysteresis are present due to transitions in initial flux values between the closely-spaced fuel injection events. Accordingly, the dwell time threshold is not defined by any fixed value, and selection thereof may be based upon, but not limited to, fuel temperature, fuel injector temperature, fuel injector type, fuel pressure and fuel properties such as fuel types and fuel blends. As used herein, the term "flux" refers to magnetic flux indicating the total magnetic field generated by the electrical coil 24 and passing through the armature portion. Since the turns of the electrical coil 24 link the magnetic flux in the magnetic core, this flux can therefore be equated from the flux linkage. The flux linkage is based upon the flux density passing through the armature portion, the surface area of the armature portion adjacent to the air gap and the number of turns of the coil 24. Accordingly, the terms "flux", "magnetic flux" and "flux linkage" will be used interchangeably herein unless otherwise stated.

For fuel injection events that are not closely spaced, a fixed current waveform independent of dwell time may be utilized for each fuel injection event because the first fuel injection event of a consecutive pair has little influence on the delivered injected fuel mass of the second fuel injection event of the consecutive pair. However, the first fuel injection event may be prone to influence the delivered injected fuel mass of the second fuel injection event, and/or further subsequent fuel injection events, when the first and second fuel injection events are closely-spaced and a fixed current wave form is utilized. Any time a fuel injection event is influenced by one or more preceding fuel injection events of an engine cycle, the respective delivered injected fuel mass of the corresponding fuel injection event can result in an unacceptable repeatability over the course of a plurality of engine cycles and the consecutive fuel injection events are considered closely-spaced. More generally, any consecutive actuator events wherein residual flux from the preceding actuator event affects performance of the subsequent actuator event relative to a standard, for example relative to performance in the absence of residual flux, are considered closely-spaced.

Exemplary embodiments are further directed toward providing feedback signal(s) 42 from the fuel injector 10 to the activation controller 80. Discussed in greater detail below, sensor devices may be integrated within the fuel injector 10 for measuring various fuel injector parameters for obtaining the flux linkage of the electrical coil 24, voltage of the electrical coil 24 and current through the electrical coil 24. A current sensor may be provided on a current flow path between the activation controller 80 and the fuel injector to measure the current provided to the electrical coil 24, or the current sensor can be integrated within the fuel injector 10 on the current flow path. The fuel injector parameters provided via feedback signal(s) 42 may include the flux linkage, voltage and current directly measured by corresponding sensor devices integrated within the fuel injector 10. Additionally or alternatively, the fuel injector parameters may include proxies provided via feedback signal(s) 42 to—and used by—the control module 60 to estimate the flux linkage, magnetic flux, the voltage, and the current within the fuel injector 10. Having feedback of the flux linkage of the electrical coil 24, the voltage of the electrical coil 24 and current provided to the electrical coil 24, the control module 60 may advantageously modify the activation signal 75 to the fuel injector 10 for multiple consecutive injection events. It will be understood that conventional fuel injectors controlled by open loop operation, are based solely upon a desired current waveform obtained from look-up tables, without any information related to the force producing component of the flux linkage (e.g., magnetic flux) affecting movement of the armature portion 21. As a result, conventional feed-forward fuel injectors that only account for current flow for controlling the fuel injector, are prone to instability in consecutive fuel injection events that are closely-spaced.

Figure 2:
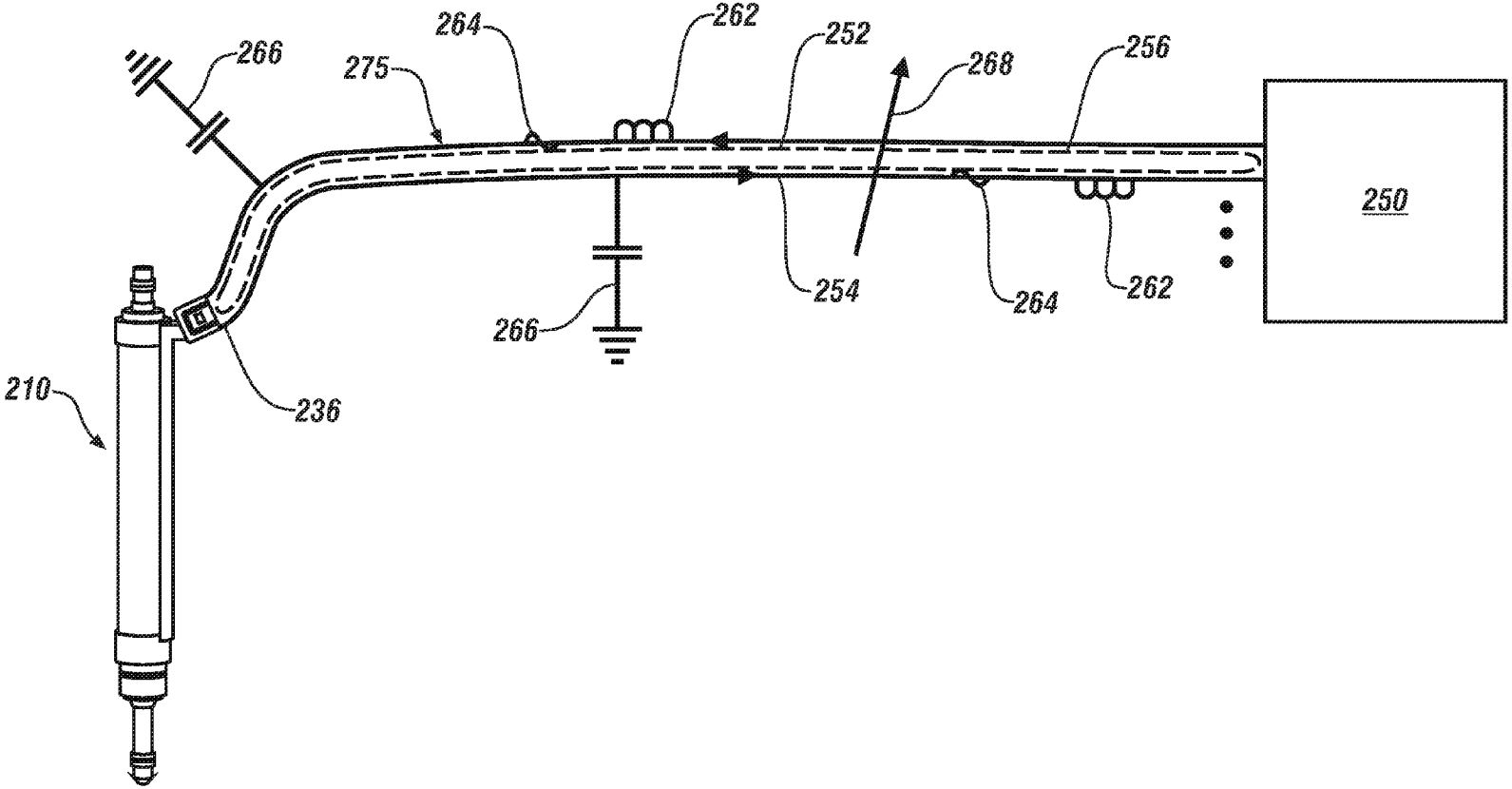
FIG. 2 illustrates a non-limiting example of a schematic sectional view of a cable electrically operatively connecting an exemplary fuel injector and an exemplary injector driver, in accordance with the present disclosure.

FIG. 2 illustrates a non-limiting example of a schematic sectional view of a cable electrically operatively connecting an exemplary fuel injector and an exemplary injector driver. The cable 275 is operative to transmit electrical power and electrical signals. The exemplary fuel injector 210 includes a connector assembly 236 having one or more electrical connectors configured to electrically operatively couple a first end of the cable 275 to the fuel injector 210. The injector driver 250 may include one or more electrical connectors configured to electrically operatively couple a second end of the cable 275 to the injector driver 250. Along a first flow path 252 of the cable 275, current flow may be provided from a high voltage DC power supply of the injector driver 250 for energizing an electromagnetic coil of the fuel injector 10 for activating a fuel injection event. A second flow path 254 provides a return path for the current from the electromagnetic coil. The injector driver 250 can be configured as a uni-directional or bi-directional current driver. A current loop 256 indicative of the resulting current flow within the cable 275 is illustrated. Additionally, fuel injector parameters within the fuel injector 210 may be provided as feedback via the cable 275 to the injector driver 250, wherein the injector driver includes a control module, e.g. processing device for receiving the feedback fuel injector parameters. The fuel injector parameters may be indicative of flux linkage, voltage and current measured directly from one or more sensing devices integrated within the fuel injector 210 or the fuel injector parameters may be indicative of proxies used by the injector driver 250 for estimating the flux linkage, voltage and current within the fuel injector 210.

In the illustrated non-limiting example of FIG. 2, the current flow and the feedback fuel injector parameters must travel a long distance of the cable 275 that electrically operatively couples the external fuel injector driver 250 with the fuel injector 210. The external fuel injector 250 may be packaged within the vehicle proximate to, or integral to, an engine control module. Accordingly, during high speed operation of the fuel injector 210 indicating changes in voltage provided from the injector driver 250, the cable 275 is operative as a power transmission line presenting undesirable interferences within the cable 275. As used herein, the term "undesirable interferences within the cable" include electrical and electromagnetic interferences within the cable 275 that impact both the current flow provided to the fuel injector 210 and the accuracy of the feedback fuel injector parameters provided to the injector driver 250. Electrical interferences can include parasitic inductance 262, resistance drop 264 and parasitic capacitance 266 along the first and second flow paths 252, 254, respectively. Electrical interferences may further include connector interferences at the electrical connectors of the fuel injector 210 and the injector driver 250. Electromagnetic interferences may include the presence of magnetic coupling, indicated as magnetic flux 268 within the cable 275, resulting from the presence of high frequency currents of the current loop 256. Magnetic interferences, such as magnetic flux 268, indicate magnetic coupling. Accordingly, deficiencies are inherently recognized when utilizing the long cable 275 to electrically operatively connect the fuel injector 210 to the external injector driver 250 of FIG. 2.

Embodiments herein are directed toward integrating an injector driver into a connector assembly of a fuel injector to eliminate the need for a cable electrically operatively connecting the fuel injector to an external injector driver for providing current flow and feedback fuel injector parameters therebetween. Embodiments are further directed toward positioning an external injector driver in close proximity to a fuel injector, wherein the external injector driver is integrated into a power transmission cable electrically operatively connecting the external injector driver to the fuel injector for controlling operation thereof. As will become apparent, eliminating the need for the cable, or greatly reducing the distance of the cable between the fuel injector and injector driver, eliminates or reduces the aforementioned undesirable electrical and electromagnetic interferences that are inherent when a long cable is required to electrically operatively connect a fuel injector and an external injector, as described above in the non-limiting example of FIG. 2.

Figures 1, 3:
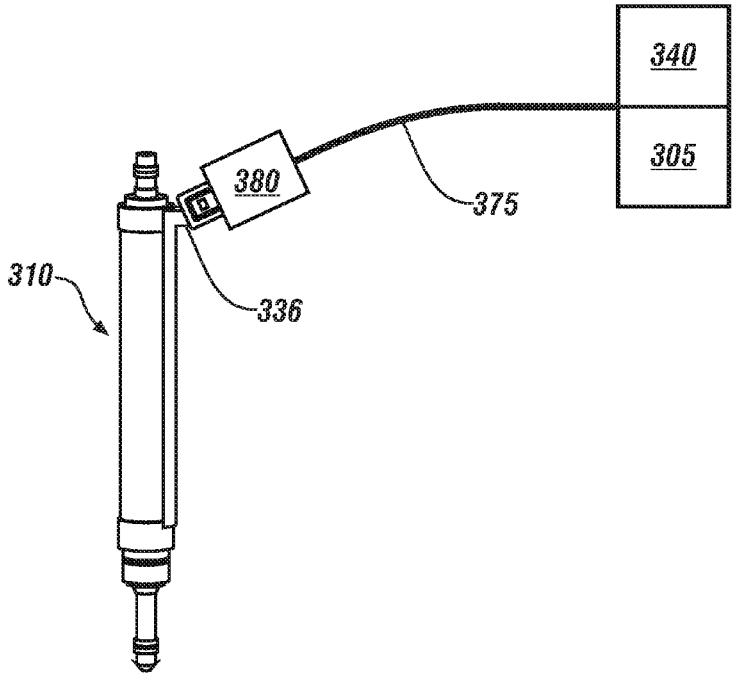
Figures 2, 3:
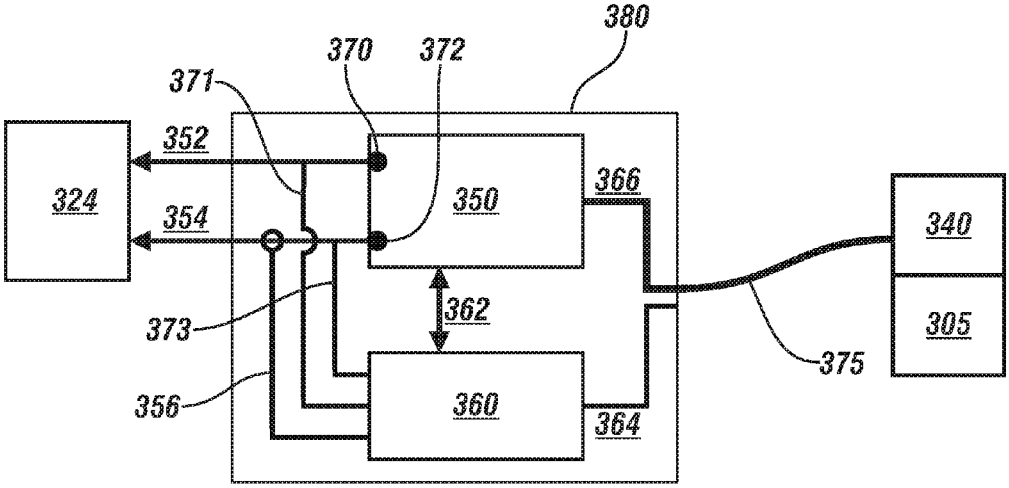
Figure 3:
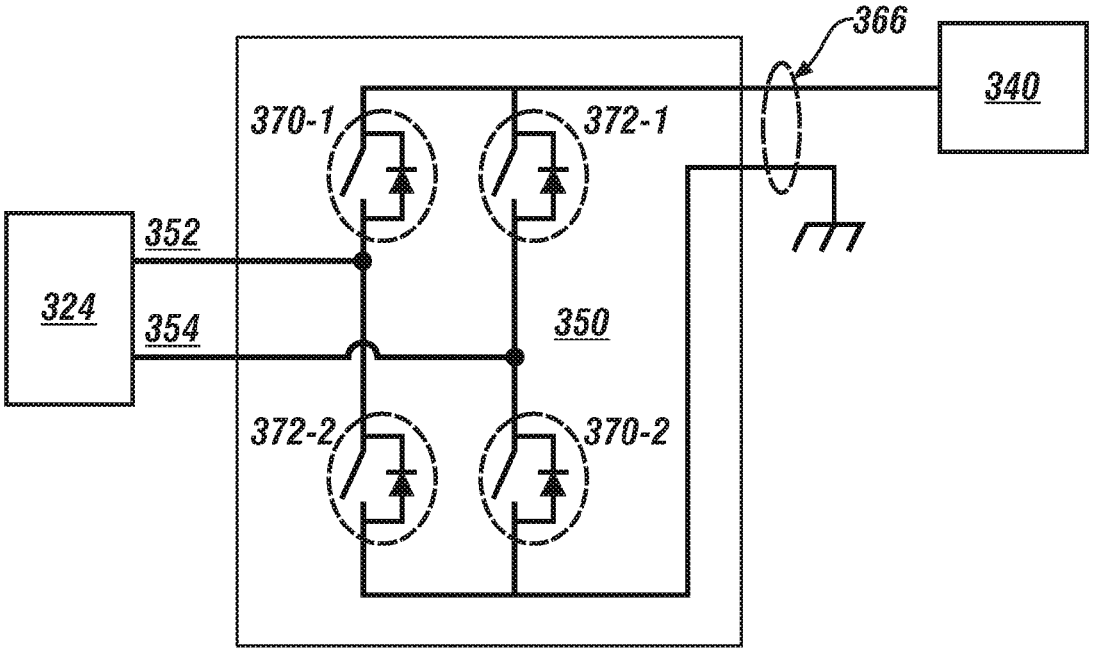

FIGS. 3-1 thru 3-3 illustrate an exemplary embodiment of an injector driver integrated within a connector assembly of the fuel injector for controlling operation thereof. FIG. 3-1 illustrates the fuel injector 310, the connector assembly 336 and an activation controller 380. An electric power source 340 provides a source of DC electric power to the activation controller 380 via power transmission cable 375. The power transmission cable 375 further includes signal wires providing signal communication between the activation controller 380 and an ECM 305. It will be appreciated that additional power transmission cables may be utilized to electrically operatively couple respective ones of other activation controllers and fuel injectors to the electric power source 340 and the ECM 305. The fuel injector 310, the activation controller 380, the power supply 340 and the ECM 305 in the illustrated embodiment of FIG. 3-1, correspond to like features having like numerals described above with reference to FIG. 1. Accordingly, FIGS. 3-1 thru 3-3 will be described with reference to FIG. 1. In the illustrated embodiment, the activation controller 380 is integrated directly within the connector assembly 336 such that electrical current flow can travel directly from the activation controller 380 for controlling operation of the fuel injector 310 without being subject to the electrical and electromagnetic interferences inherent to long cables electrically connecting power drivers to fuel injectors, as described above in the non-limiting example of FIG. 2.

FIG. 3-2 illustrates the activation controller 380 integrated into the connector assembly 336 of FIG. 3-1. It will be understood that while the activation controller 380 is integrated into the connector assembly 336, the ECM 305 and the power source 340 are external to the connector assembly 336. The activation controller 380 is respective to only the fuel injector 10. In engines employing more than one fuel injector, a separate activation controller is integrated into the connector assembly for each fuel injector. The activation controller 380 includes a control module 360 and an injector driver 350. Signal flow path 362 provides communication between the control module 360 and the injector driver 350. For instance, signal flow path 362 provides the injector command signal (e.g., command signal 52 of FIG. 1) that controls the injector driver 350, which activates the fuel injector 310 to effect a fuel injection event. The control module 360 further communicates with the external ECM 305 via signal flow path 364 within the activation controller 380 that is in electrical communication with power transmission cable 375. For instance, signal flow path 364 may provide monitored input parameters (e.g., monitored input parameters 51 of FIG. 1) from the ECM 305 to the control module 360 for generating the injector command signal. In some embodiments, the signal flow path 364 may provide feedback fuel injector parameters (e.g., feedback signal 42 of FIG. 1) to the ECM 305.

The injector driver 350 receives DC electric power from power source 340 via the power transmission cable 375 and a power supply flow path 366. In one embodiment, the power source 340 is a high voltage power source. Using the received DC electric power, the injector driver may generate injector activation signals (e.g., injector activation signals 75 of FIG. 1) based on the injector command signal from the control module 360.

The injector driver 350 is configured to control activation of the fuel injector 10 by generating suitable injector activation signals that are communicated by the injector cable 75. In the illustrated embodiment, the injector driver 350 is a bi-directional current driver providing positive and negative drive currents via a first current flow path 352 and a second current flow path 354 to an electromagnetic coil 324 within the fuel injector 310 in response to respective injector activation signals. Current flow paths 352 and 354 form a closed loop; that is, a positive current into 352 results in an equal and opposite (negative) current in flow path 354, and vice versa. Signal flow path 371 can provide a voltage of the first current flow path 352 to the control module 360 and signal flow path 373 can provide a voltage of the second current flow path 354 to the control module 360. In one embodiment, the injector driver 350 utilizes open loop operation to control activation of the fuel injector 310, wherein the injector activation signals are characterized by precise predetermined current waveforms. In another embodiment, the injector driver 350 utilizes closed loop operation to control activation of the fuel injector 310, wherein the injector activation signals are based upon fuel injector parameters provided as feedback via the signal flow paths 371 and 373 to the control module 360. A measured current flow to the coil 324 can be provided to the control module 360, via signal flow path 356. The monitored current can be obtained from a current sensor on the second current flow path 354 in the illustrated embodiment. The fuel injector parameters may include flux linkage, voltage and current values within the fuel injector 310 or the fuel injector parameters may include proxies used by the control module 360 to estimate flux linkage, voltage and current within the fuel injector 310.

In some embodiments, the injector driver 50, 350 is configured for full four quadrant operation. FIG. 3-3 illustrates an exemplary embodiment of the injector driver 350 of FIGS. 3-2 utilizing two switch sets 370 and 372 to control the current flow provided between the injector driver 350 and the electrical coil 324. In the illustrated embodiment, the first switch set 370 includes switch devices 370-1 and 370-2 and the second switch set 372 includes switch devices 372-1 and 372-2. The switch devices 370-1, 370-2, 372-1, 372-2 can be solid state switches and may include Silicon (Si) or wide band gap (WBG) semiconductor switches enabling high speed switching at high temperatures. The four quadrant operation of the injector driver 350 controls the direction of current flow into and out of the electrical coil 324 based upon a corresponding switch state determined by the control module 360. The control module 360 may determine a positive switch state, a negative switch state and a zero switch state and command the first and second switch sets 370 and 372 between open and closed positions based on the determined switch state. In the positive switch state, the switch devices 370-1 and 370-2 of the first switch set 370 are commanded to the closed position and the switch devices 372-1 and 372-2 of the second switch set 372 are commanded to the open position to control positive current into the first current flow path 352 and out of the second current flow path 354. These switch devices may be further modulated using pulse width modulation to control the amplitude of the current. In the negative switch state, the switch devices 370-1 and 370-2 of the first switch set 370 are commanded to the open position and the switch devices 372-1 and 372-2 of the second switch set 372 are commanded to the closed position to control negative current into the second current flow path 354 and out of the first current flow path 352. These switch devices may be further modulated using pulse width modulation to control the amplitude of the current. In the zero switch state, all the switch devices 370-1, 370-2, 372-1, 372-2 are commanded to the open position to control no current into or out of the electromagnetic assembly. Thus bi-directional control of current through the coil 24 may be effected.

In some embodiments, the negative current in the reversed direction through the electrical coil 324 is applied for a sufficient duration for reducing residual flux within the fuel injector 310 after a secondary hold current is released. In other embodiments, the negative current is applied subsequent to release of the secondary hold current but additionally only after the fuel injector has closed or actuator has returned to its static or rest position. Moreover, additional embodiments can include the switch sets 370 and 372 to be alternately switched between open and closed positions to alternate the direction of the current flow to the coil 324 including pulse width modulation control to effect current flow profiles. The utilization of two switch sets 370 and 372 allows for precise control of current flow direction and amplitude applied to the current flow paths 352 and 354 of the electrical coil 324 for multiple consecutive fuel injection events during an engine event by reducing the presence of eddy currents and magnetic hysteresis within the electrical coil 324.

Figure 4:
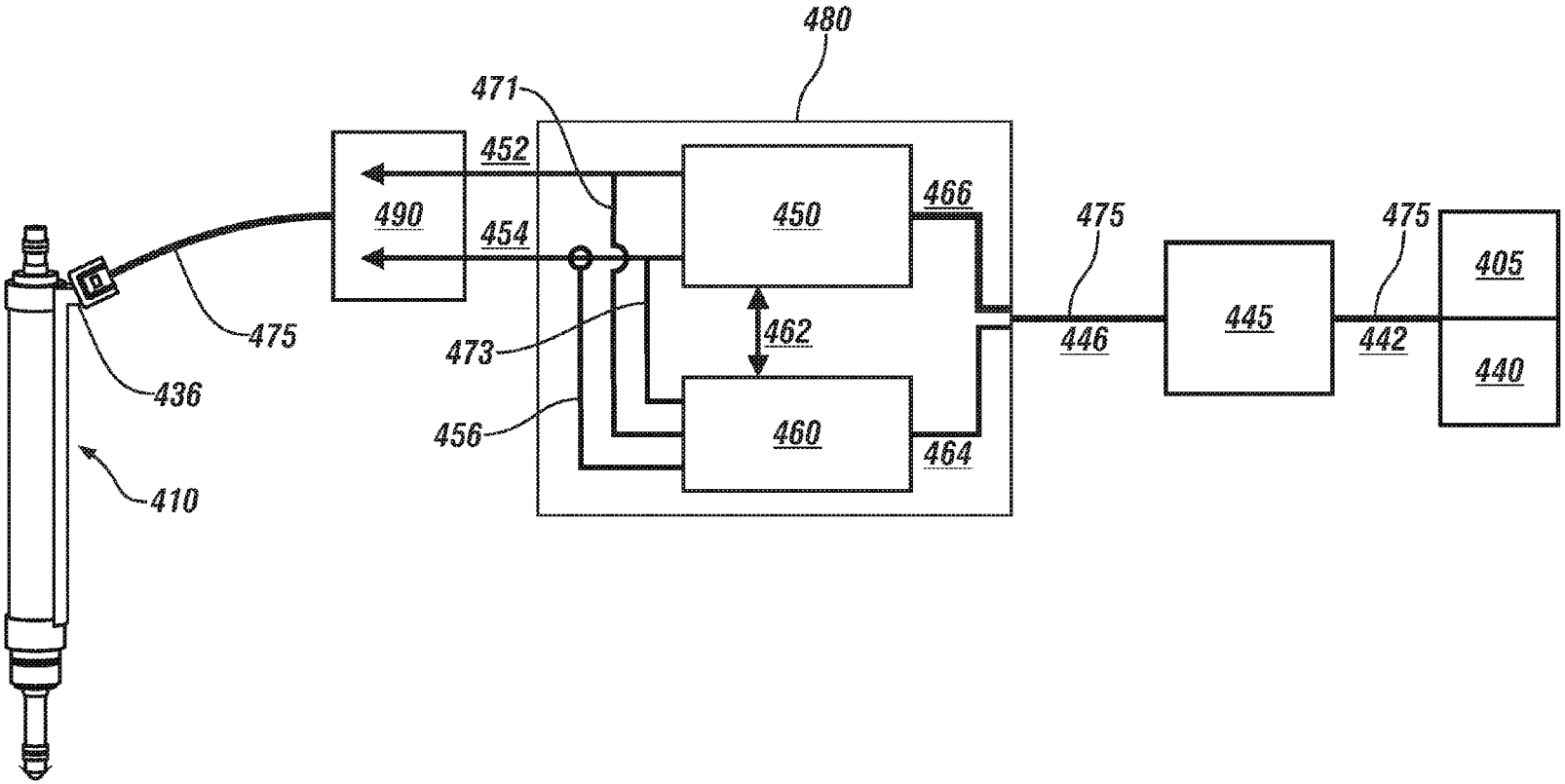
FIG. 4 illustrates an exemplary embodiment of an injector driver integrated into a power transmission cable electrically operatively connecting the external injector driver to a connector assembly of a fuel injector for controlling operation thereof, in accordance with the present disclosure.

FIG. 4 illustrates an exemplary embodiment of an injector driver integrated into a power transmission cable electrically operatively connecting the external injector driver to a connector assembly of a fuel injector for controlling operation thereof. A power transmission cable 475 electrically operatively connects an electric power source 440 to a boost converter 445, the boost converter 445 to an activation controller 480, and the activation controller 480 to the connector assembly 436 of the fuel injector 410. The fuel injector 410, the activation controller 480, the power supply 440, the power transmission cable 475 and the ECM 405 in the illustrated embodiment of FIG. 4, correspond to like features having like numerals described above with reference to FIG. 1. Accordingly, FIG. 4 will be described with reference to FIG. 1. In the illustrated embodiment, the activation controller 480 is integrated into the power transmission cable 475 in-line with—and in close proximity to—the connector assembly 436 of the fuel injector 410. Accordingly, electrical current flow can travel a short distance via the power transmission cable 475 from a power driver 450 of the activation controller 480 for controlling operation of the fuel injector 410 without being subject to the electrical and electromagnetic interferences inherent to long cables electrically connecting power drivers to fuel injectors, as described above in the non-limiting example of FIG. 2.

In the illustrated embodiment, the boost converter 445 includes a DC-DC converter operative to increase an input source voltage 442 from the electric power source 440. The boost converter 445 thereby outputs an increased voltage 446 that is provided to the activation controller 480, wherein the increased voltage 446 output from the boost converter 445 includes a magnitude of voltage greater than the input source voltage 442 provided from the electric power source 440. In one embodiment, the electric power source is a 12 V energy storage device. Accordingly, the boost converter 445 enables high voltage, e.g., 24 V to 200 V, to be supplied to the activation controller 480 for activating the fuel injector 410. It will be understood that output current from the boost converter 445 must be decreased from source current input to the boost converter 445 such that electrical power is conserved. The boost converter 445 may include at least two semiconductor switches such, as a diode and a transistor, a capacitor, and a conductor. Filter made of capacitors (sometimes in combination with inductors) are normally added to the output of the boost converter 445 to reduce output voltage ripple. In one embodiment, the transistor is a metal-oxide-semiconductor field-effect transistor (MOSFET).

Operation of the activation controller 480 of FIG. 4 is substantially identical to the activation controller 380 of FIGS. 3-1 and 3-2, wherein like numerals refer to like features. Accordingly, operation of the activation controller 480 of FIG. 4 that is similar to the activation controller 380 of FIGS. 3-1 and 3-2 will not be described in detail. Using the high voltage 446 from the boost converter 445, the injector driver 450 may generate injector activation signals (e.g., injector activation signals 75 of FIG. 1) based on the injector command signal (e.g. injector command signal 52 of FIG. 1) from the control module 460.

In the illustrated embodiment, the injector driver 450 is a bi-directional current driver providing controlled current flow via the first current flow path 452 and second current flow path 454 to an electromagnetic coil within the fuel injector 410 in response to respective injector activation signals.

In the illustrated embodiment, injector driver 450 includes at least two switch devices configured to permit or restrict current flow via the first and second current flow paths 452, 454, respectively, and the fuel injector 410 via the power transmission cable 475. In one embodiment, the switch devices within the injector driver 450 are solid state switches and may include Silicon (Si) or wide bandgap (WBG) semiconductor switches. Based upon the injector command signal from the control module 460 and the corresponding injector activation signal, the injector driver 450 may command the switch devices between open and closed positions. In some embodiments, the negative current for drawing current from the electromagnetic coil is applied for a sufficient duration after an injection event for reducing residual flux within the fuel injector. The utilization of the at least two switch devices of the injector driver 450 allows for precise control of current flow applied to the electromagnetic coil 424 for multiple consecutive fuel injection events during an engine event by reducing the presence of residual flux caused by persistent eddy currents and magnetic hysteresis within the electromagnetic coil of the fuel injector 410. In some embodiments, the injector driver 450 is configured for full four quadrant operation, wherein the at least two switch devices include two switch sets to control the current flow provided between the injector driver 450 and the electrical coil 424 in a manner analogous to the injector driver 350 described above with respect to FIG. 3-3.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus for controlling operation of an electromagnetically-activated actuator, comprising:
   - an activation controller that is one of integrated within a connector assembly of the actuator and integrated into a power transmission cable in close proximity to the actuator, the activation controller comprising:
     - a control module configured to generate an actuator command signal, and
     - an actuator driver comprising a bi-directional current driver configured to receive the actuator command signal from the control module and generate an activation command signal for controlling the direction and amplitude of the current provided to the actuator.

2. The apparatus of claim 1, wherein the activation controller is located in a proximity to the actuator that prevents an electrical current flow between the activation controller and the actuator from being subjected to an undesirable interference.

3. The apparatus of claim 1, wherein the actuator is a direct-injection fuel injector and the control module generated actuator command signal includes a desired injected fuel mass to be delivered by the fuel injector to a combustion chamber of an internal combustion engine.

4. The apparatus of claim 1 further comprising at least one sensor device integrated within the body of the actuator and electrically operatively coupled to the activation controller, the at least one sensor device configured to measure one or more parameters during operation of the actuator that are provided as feedback to the activation controller.

5. The apparatus of claim 4, wherein the one or more parameters provided as feedback to the activation controller are indicative of one of flux linkage, voltage and current within the actuator.

6. The apparatus of claim 4, wherein the activation controller is further configured to modify operation of the actuator based upon the feedback parameters of the actuator.

7. The apparatus of claim 1, wherein the activation controller is integrated within the connector assembly of the actuator such that electrical current flow can travel directly from the activation controller for controlling the actuator.

8. The apparatus of claim 1, wherein the activation controller is integrated into a power transmission cable in close proximity to the actuator, the power transmission cable electrically operatively connecting the activation controller to the connector assembly of the actuator.

9. The apparatus of claim 8, wherein the activation controller is electrically operatively connected to an external control module and an external power supply by a second power transmission cable.

10. The apparatus of claim 8, wherein the activation controller is electrically operatively connected to a boost converter which is electrically operatively connected to an external control module and an external power supply.

11. The apparatus of claim 1, wherein the actuator driver comprises two switch sets configured to control a current flow between the actuator driver and the actuator based upon a switch state determined by the control module.

12. Apparatus for controlling operation of an electromagnetically-activated direct-injection fuel injector, comprising:
   - an activation controller that is one of integrated within a connector assembly of the fuel injector and integrated into a power transmission cable in close proximity to the fuel injector, the activation controller comprising:

a control module configured to generate an injector command signal including a desired injected fuel mass to be delivered by the fuel injector to a combustion chamber of an internal combustion engine, and an injector driver comprising a bi-directional current driver configured to receive the injector command signal from the control module and generate an activation command signal for controlling the direction and amplitude of the current provided to the fuel injector.

13. The apparatus of claim 12, wherein the activation controller is located in a proximity to the fuel injector that prevents an electrical current flow between the activation controller and the fuel injector from being subjected to an undesirable interference.

14. The apparatus of claim 12 further comprising at least one sensor device integrated within the body of the fuel injector and electrically operatively coupled to the activation controller, the at least one sensor device configured to measure one or more parameters during operation of the fuel injector that are provided as feedback to the activation controller.

15. The apparatus of claim 14, wherein the one or more parameters provided as feedback to the activation controller are indicative of one of flux linkage, voltage and current within the fuel injector.

16. The apparatus of claim 14, wherein the activation controller is further configured to modify operation of the fuel injector based upon the feedback parameters of the fuel injector.

17. The apparatus of claim 12, wherein the activation controller is integrated within the connector assembly of the fuel injector such that electrical current flow can travel directly from the activation controller for controlling the fuel injector.

18. The apparatus of claim 12, wherein the activation controller is integrated into a power transmission cable in close proximity to the fuel injector, the power transmission cable electrically operatively connecting an output end of the activation controller to the connector assembly of the actuator and an input end of the activation controller to an external control module and an external power supply.

19. The apparatus of claim 12, wherein the actuator driver comprises two switch sets configured to control a current flow between the actuator driver and the actuator based upon a switch state determined by the control module.

20. Apparatus for controlling operation of an electromagnetically-activated direct-injection fuel injector, comprising:

an electromagnetic fuel injector, including at least one sensor device integrated within the body of the fuel injector and electrically operatively coupled to an activation controller and configured to measure one or more parameters during operation of the fuel injector that are provided as feedback to the activation controller;

an external control module and a power source electrically operatively coupled to an activation controller, the external control module and the power source located externally to the fuel injector;

the activation controller that is one of integrated within a connector assembly of the fuel injector and integrated into a power transmission cable in close proximity to the fuel injector, the activation controller comprising:

a control module configured to generate an injector command signal including a desired injected fuel mass to be delivered by the fuel injector to a combustion chamber of an internal combustion engine, and an injector driver comprising a bi-directional current driver configured to receive the injector command signal from the control module and generate an activation command signal for controlling the direction and amplitude of the current provided to the fuel injector.

* * * * *